US009970724B1

(12) United States Patent
Acker

(10) Patent No.: US 9,970,724 B1
(45) Date of Patent: May 15, 2018

(54) COLT 1911 BLOCKING TRIGGER

(71) Applicant: Thomas W. Acker, Largo, FL (US)

(72) Inventor: Thomas W. Acker, Largo, FL (US)

( * ) Notice: Subject to any disclaimer, the term of this patent is extended or adjusted under 35 U.S.C. 154(b) by 0 days. days.

(21) Appl. No.: 15/856,620

(22) Filed: Dec. 28, 2017

Related U.S. Application Data

(60) Provisional application No. 62/539,165, filed on Jul. 31, 2017.

(51) Int. Cl.
*F41A 17/00* (2006.01)
*F41A 17/46* (2006.01)

(52) U.S. Cl.
CPC ..... *F41A 17/46* (2013.01)

(58) Field of Classification Search
CPC ..... F41A 17/46; F41A 19/10
See application file for complete search history.

(56) References Cited

U.S. PATENT DOCUMENTS 1,389,944 A * 9/1921 Garrison ..... F41A 17/36 42/7
1,410,265 A * 3/1922 Pedersen ..... F41A 3/32 89/145
4,203,348 A * 5/1980 Sokolovsky ..... F41A 17/38 42/70.04
4,539,889 A 9/1985 Glock
4,754,568 A 7/1988 Brandt
4,825,744 A 5/1989 Glock
5,025,582 A 6/1991 Mote
5,355,768 A 10/1994 Felk
5,402,593 A 4/1995 Lenkarski
5,560,134 A 10/1996 Van Niekerk
5,822,903 A * 10/1998 Davis, Sr. ..... F41A 19/16 42/69.01
6,164,001 A * 12/2000 Lee ..... F41A 19/10 42/69.01
6,212,812 B1 4/2001 Aigner
(Continued)

FOREIGN PATENT DOCUMENTS

AT 15313 5/2017
GB 191104607 A * 3/1911 ..... F41A 17/38
WO WO2015/157753 A1 10/2015

OTHER PUBLICATIONS

YouTube Video—Glock Safe Action Trigger (explained).
YouTube Video—Animation of a 1911 Pistol's Operation.

*Primary Examiner* — Gabriel Klein
(74) *Attorney, Agent, or Firm* — Robert M. Schwartz; Alfred K. Dassler

(57) ABSTRACT

This device is a trigger safety designed for use on the Colt model 1911 pistol and clones of the same design. The primary safety of the 1911 design is a thumb safety located on the left rear of the firearm. The location of the thumb safety is not an issue under normal circumstances, but in high stressful situations where the shooter is anticipating the firing of the firearm the thumb safety location is troublesome. Under stress the shooter may forget that the thumb safety is engaged, and may pull the trigger without the gun firing. The time needed to disengage the thumb safety may result in a life or death situation. This device incorporates a two stage safety in the trigger system that functions when all other safeties are in the off position. The location within the trigger eliminates the fractional second delay that the thumb safety may cause.

3 Claims, 10 Drawing Sheets

(56) References Cited

U.S. PATENT DOCUMENTS

| | | | | |
|---|---|---|---|---|
| 6,223,460 | B1 | 5/2001 | Schmitter | |
| 6,298,594 | B1 * | 10/2001 | Strayer | F41A 19/10 42/69.01 |
| 6,405,468 | B1 * | 6/2002 | Gilgenbach | F41A 17/22 42/70.01 |
| 6,647,655 | B2 | 11/2003 | Salvitti | |
| 6,843,013 | B2 | 1/2005 | Cutini et al. | |
| 9,488,428 | B2 | 11/2016 | Olivias | |
| 2015/0117841 | A1 * | 4/2015 | Brammer | H05B 3/02 392/387 |
| 2015/0292828 | A1 * | 10/2015 | Nebeker | F41A 17/72 42/69.01 |
| 2017/0059267 | A1 * | 3/2017 | Hudson, III | F41A 19/12 |

* cited by examiner

COLT 1911 BLOCKING TRIGGER

CROSS-REFERENCE TO RELATED APPLICATION

This application claims benefit of U.S. Provisional Patent Application 62/539,165 filed Jul. 31, 2017, entitled Colt 1911 Blocking Trigger. The prior application is incorporated herein in its entirety.

BACKGROUND OF THE INVENTION

Field of the Invention

This device relates to safeties on automatic pistols of the type which automatically eject the spent cartridge and chamber a new one after each shot, more specifically, the Colt model 1911 (Colt's Manufacturing Company LLC, Hartford Conn., USA) and clones of the same design.

The device of this application pertains to safety issues of the Colt model 1911 pistol. The Colt model 1911 pistol is a single action, semi-automatic, magazine fed, recoil operated pistol, usually chambered in the popular 45 ACP (Automatic Colt Pistol, Hartford, Conn.) cartridge. This gun has served as the standard issue sidearm for the United States Armed Forces from 1911 to 1986, however, some variants of this pistol are still in use today by special forces. Designed by John Browning, the 1911 with its basic design is the most widely copied design, and the operating system has risen to become the predominant type of the 20th century. Throughout the years changes have been made to the exterior appearance, but few internal changes have been made, and most of the parts remain interchangeable. To this date there are over one hundred firearm manufacturers other than Colt that produce copies or clones of this 1911 basic design for civilian hunting, target, and self-defense usage.

For military use, the military mandated a grip safety and a manual safety for their firearms. The grip safety becomes inactive when the pistol is firmly gripped in the shooters hand. The manual safety is currently referred to as the thumb safety which is located on the left rear of the firearm, but other safeties include slide stop, half cock position, a sear disconnect, and a firing pin block safety. With the above-mentioned safeties, the 1911 model remains one of the safest pistol designs available under normal shooting conditions. The favored mode of carry for the 1911 design and its clones is to carry the pistol with a live round of ammunition within the pistol's chamber, with the hammer in the full cock position, and the thumb safety in the safe or "on" position. With all the above-mentioned safeties to function as designed, the one major requirement is the presence of mind to remember that the cocked and locked favored carry mode requires the shooter to have his thumb on the thumb safety, ready to disengage or move the thumb safety to the fire position, which now allows the shooter to pull the trigger. This required presence of mind, especially for those not formally trained for combat, is very easily overlooked in a tense, stressful situation. In this stressful condition, when the shooter wants the gun to fire, and it doesn't, the shooter must then remember that the thumb safety is still engaged and must be moved to the fire position, this time delay may result in the firearm shooters death. The use of the device of this application, places the final safety at the shooters fingertip, and reduces the time to fire the pistol.

The field of this device pertains to the PTO Classification, Class 42 (firearms) sub class 70.01 (safety mechanism) and further to 70.06 (trigger lock) which covers devices, including means, that prevent the trigger device of a firearm from movement. The device of this application is a trigger replacement assembly for the Colt model 1911 and clones of the same design. The device provides a two stage trigger of which the first stage is a blocking system preventing trigger movement and the second stage that allows the pistol to fire. By adding an additional safety within the replacement trigger assembly, the assembly allows the thumb safety to be placed in the "fire" position at the first anticipation of usage while providing a final safety at the shooters fingertip.

SUMMARY OF THE INVENTION

The device of this application is a replacement trigger assembly that incorporates an additional safety for the Colt model 1911 pistol and its clones. This replacement trigger assembly does not require any modifications to the frame of the firearm. This device is a final safety when the thumb safety is in the "off" or fire position. The safety functions by blocking the movement of the trigger assembly which in turn would apply movement to release the sears engagement to the hammer and allowing the firing of the chambered round. The blocking of trigger movement is by means of a secondary trigger shoe which may be constructed as non-adjustable or adjustable, within the primary trigger shoe. The secondary trigger shoe is held in place within the primary trigger by a spring and pin which functions as an axle on which the secondary trigger shoe is allowed to rotate. The pin location should be placed on or near the horizontal plane of the magazine catch bar. A portion of the secondary trigger shoe is held forward under spring pressure, and protrudes beyond the primary trigger shoe, while the portion of the secondary trigger shoe rearward of the pin is in line and allowed to contact the magazine catch bar which is present in all 1911 designs and its clones. The position of the rearward portion of the secondary trigger shoe resting against the magazine catch bar prevents trigger movement.

The trigger movement blocking is disengaged when pressure is applied to the forward protruding portion of the secondary trigger shoe. This causes a downward rotation of the secondary trigger shoe, moving the arresting portion against the magazine catch bar, down and away from the magazine catch bar, providing space for trigger movement. When the secondary trigger has finger pressure applied, and the blocking is disengaged, the secondary trigger becomes flush with the primary trigger. At this flush position of secondary trigger shoe movement, the primary trigger shoe now functions as a standard trigger which will discharge the firearm with continued pressure being applied to the primary trigger. After the trigger has moved rearward enough to release the sears engagement and the pistol fires the chambered round, the trigger rearward travel is stopped when the secondary trigger shoe follow through contact surface, makes contact with the magazine catch bar. With the use of this device, the shooter now has the final safety located at his finger, while his finger is on the trigger. The position and use of the final safety eliminates the life or death time delay due to the releasing of the thumb safety. Under a high stressful condition, the thumb safety may be left in the "on" position requiring the presence of mind and additional time to move the thumb safety to the "off" position, allowing the gun to fire.

The trigger safety system of this application designed for the Colt model 1911 automatic pistol and its clones is a self-contained system that is designed to be a "drop in" system that does not require modification to the frame or the receiver. The trigger is a self-contained system that is designed to be a "drop in" system that does not require modification to the firearm frame or receiver. The trigger system is composed of a secondary trigger shoe within a primary trigger shoe offering an additional safety system to the firearm. The system functions to block the trigger from movement until the secondary trigger has enough pressure applied by the shooters trigger finger to cause the rearward end of the secondary trigger to rotate downwards to allow the primary trigger, space to move rearward allowing the firearm to discharge the chambered round.

The trigger safety system may be equipped with either a standard non-adjustable secondary trigger shoe or an adjustable secondary trigger shoe.

The trigger safety system can be manufactured from a variety of different materials, such as plastic, aluminum, or steel. The method of manufacturing may be plastic injection molding or stamp formed and or machined by milling. The favored method of manufacturing being the injection molding process, using a plastic material such as carbon fiber filled PolyEtherEtherKetone (PEEK), which gives high strength with low friction.

The trigger safety system has a secondary trigger within a primary trigger shoe that at rest, the forward end of the secondary trigger shoe protrudes outward and forward from the primary trigger shoe.

When the trigger safety system is at rest with no pressure applied to the trigger system, the rearward end of the secondary trigger shoe has contact surfaces which contact the magazine catch bar, blocking trigger movement.

The trigger safety system is such that the secondary trigger, under finger pressure, is allowed to rotate on an axle that is secured within the primary trigger shoe.

The trigger safety system is such that the rotation of the secondary trigger shoe, causes the rearward end of the secondary trigger shoe to arc downward and away from the magazine catch bar creating space for trigger movement.

The trigger safety system is such that the adjustable secondary trigger shoe has two through passages from front to rear. Said passages contain internal threads that allow the use of adjustable set screws.

The trigger safety system is such that the adjustable secondary trigger shoe has threaded passages that contain adjustable set screws, the lower of which functions as a trigger movement block, and the upper functions as to allow adjustment of trigger follow through, both of which utilize the magazine catch bar as a travel stop.

The trigger safety system is such that the forward pressure to the secondary trigger shoe is caused by a spring under load pressure between the secondary trigger shoe and the primary trigger shoe.

The trigger safety system is such that the spring may be constructed of metal or plastic in the design shape of a leaf spring or coil spring.

The trigger safety system is such that the adjustable secondary trigger shoe set screws may be adjusted by means of internal passages through the secondary trigger shoe from the forward end of the secondary trigger to the forward end of the adjustable set screws, allowing for an adjustment tool to be inserted.

The trigger safety system is such that the primary trigger shoe and the trigger bow are constructed as a single unit which transfers trigger movement around the ammunition magazine and to the firearm related firing mechanism.

The trigger safety system that stays active when all other safeties are in the fire position until pressure is applied to the front protruding portion of the secondary trigger shoe.

The trigger safety system offers a ready safety system that does not need any finger or thumb movement other than the trigger finger to discharge the firearm.

The trigger safety system reduces the reaction time to fire the firearm while under stressful conditions.

The trigger safety system blocks the trigger from movement should the firearm be subjected to inertia from the firearm being accidentally dropped.

The trigger safety system, does not require any changes to the pistols frame or receiver.

DETAILED DESCRIPTION OF PREFERRED EMBODIMENT

The device of this application is a two stage trigger system that adds an additional safety to the firearm and moves the location of the final safety to the pistols trigger assembly. The device is a trigger safety system specifically for the Colt model 1911 pistol and its clones that does not require any modifications to the pistol frame or receiver. This unique trigger assembly once installed transfers the firearm final safety from the thumb safety, located at the left rear of the pistols slide, to the trigger itself. With the final safety located within the trigger assembly, the shooter has quicker response time to fire the firearm.

The main objective of this device is to lessen the possibility of confusion that may result from the shooter trying to use the pistol with the pistol in the cocked and locked mode of carry. It is normal for the shooter to have his finger on the trigger, when entering into a stressful situation. At a point of high stress, the shooter is liable to forget that the thumb safety is still engaged, and tries to fire the pistol without success. The shooter now must gather the presence of mind to remember that the thumb safety is still engaged, and to move his thumb up to the thumb safety lever and disengage it. With the device of this application the shooter, now anticipating use of the pistol, first moves the thumb safety to the off position, but still retains a final safety within the trigger assembly.

The favored method of manufacturing for this device is by the plastic injection molding process. There are many benefits of the injection molding process such as cost of material, manufacturing time, tool life, and the ability to combine the primary trigger shoe and the trigger bow into a single unit. The process begins with the construction of a cavity in the shape of the desired product within a steel mold base. The mold is then mounted in an injection press of suitable tonnage. The injection press is loaded with the product material to inject into the mold cavity. A material of high technical composition, such as carbon fiber filled PolyEtherEtherKetone (PEEK) plastic, that offers high compressive strength and stiffness, impact and abrasion resistance, and low friction would be the preferred product material. After the injection process is complete the product is hardened by either heating or by chilling of the mold.

Alternate methods of manufacturing may utilize aluminum or steel materials which may be stamp formed and or machine milled to shape. If material such as aluminum or steel is used, the excessive material waste becomes a cost issue. The method of manufacturing the original Colt 1911 trigger assembly is to produce two separate parts, the trigger shoe and the trigger bow, and then press, clamp, or weld the two pieces to form a single unit. This process is used in order to speed production, increase tool life and cut the over-all cost of production.

Figure 1:
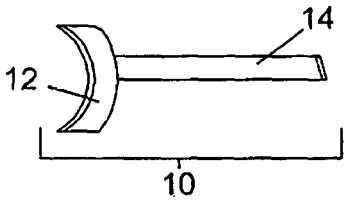
FIG. 1 PRIOR ART
FIG. 1 is a side view of prior art trigger assembly.

FIG. 1 shows the Colt 1911 prior art trigger assembly (10) consisting of, original trigger shoe (12) and original trigger bow (14).

Figure 2:
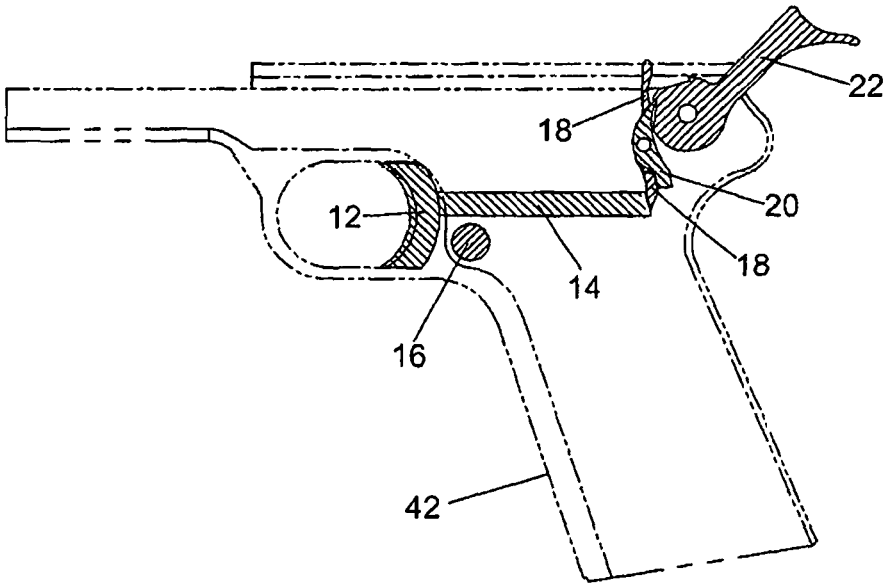
FIG. 2 PRIOR ART
FIG. 2 is a side view of prior art trigger assembly, and related firing mechanism components within an outline of the 1911 frame in dashed lines to show placement of the trigger assembly.

FIG. 2 shows the Colt 1911 prior art trigger assembly, and related firing mechanism components; sear (20), disconnector (18), and hammer (22) in operating position within an outline of the 1911 frame (42) and placement of the magazine catch bar (16).

Figure 3:
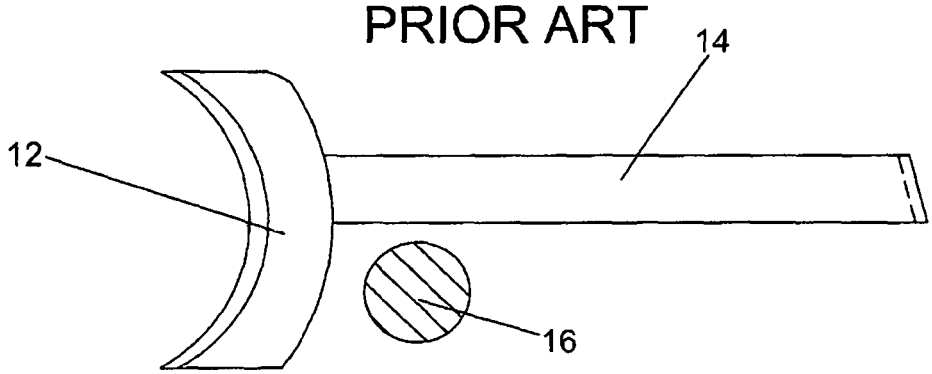
FIG. 3 PRIOR ART
FIG. 3 is a side view of prior art trigger and magazine catch bar placement.

FIG. 3 represents the Colt 1911 prior art trigger assembly components, original trigger shoe (12), and original trigger bow (14) in relationship to the magazine catch bar (16) when no pressure is applied to the original trigger shoe (12).

Figure 4:
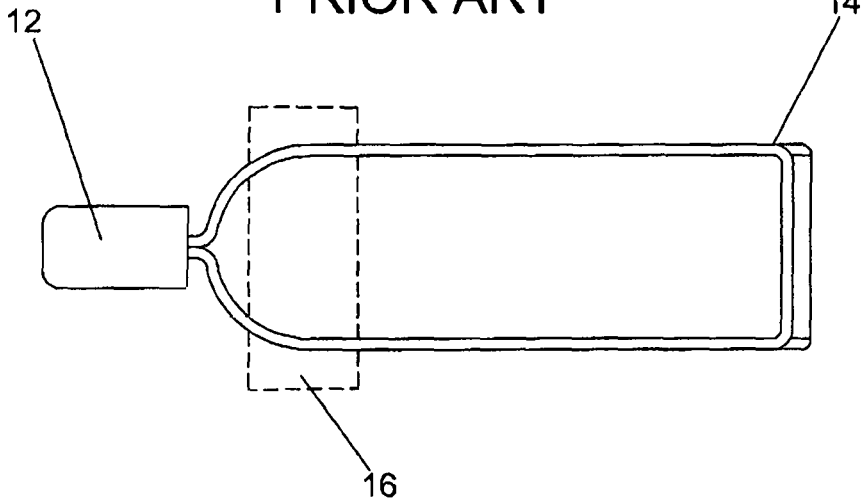
FIG. 4 PRIOR ART
FIG. 4 is a top view of prior art trigger and magazine catch bar placement.

FIG. 4 shows a top view of the Colt 1911 prior art original trigger shoe (12) and original trigger bow (14) in relationship to the magazine catch bar (16) with no pressure applied to the original trigger shoe (12).

Figure 5:
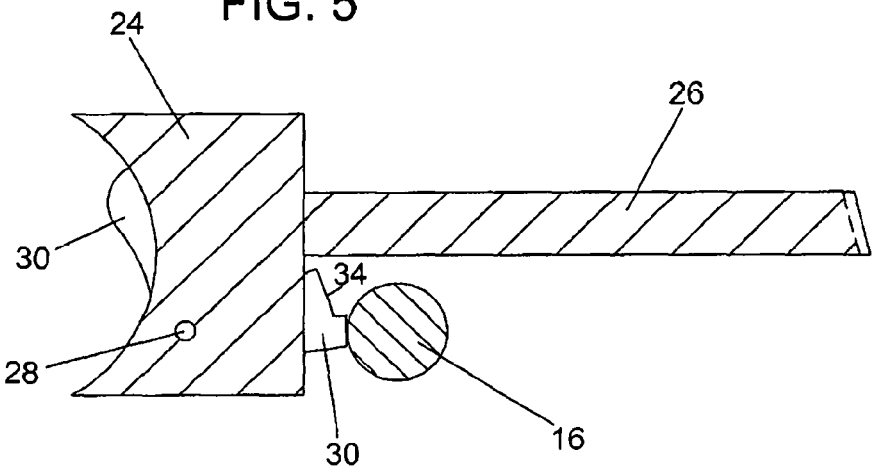
FIG. 5 shows the trigger assembly including non-adjustable secondary trigger shoe.

FIG. 5 shows the trigger assembly of this device, incorporating new primary trigger shoe (24), new trigger bow (26), secondary non-adjustable trigger shoe (30), pivot pin (28) and secondary non-adjustable trigger shoe (30) in contact with the magazine catch bar (16) blocking primary trigger shoe (24) from movement.

Figure 6:
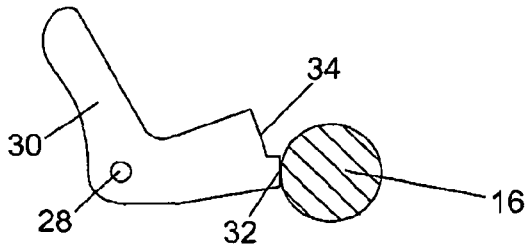
FIG. 6 shows the secondary trigger shoe making contact with the magazine catch bar.

FIG. 6 shows non-adjustable trigger shoe (30) in trigger movement arrested position by making contact with the magazine catch bar (16) and showing location of trigger pin (28) follow through arresting contact surface (34) and trigger arresting contact surface (32).

Figure 7:
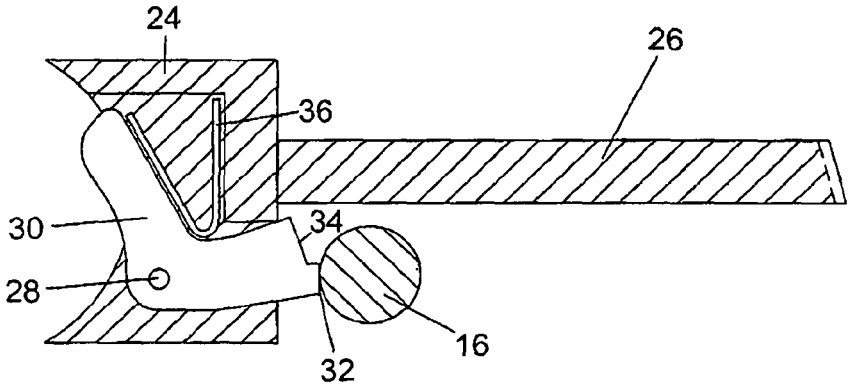
FIG. 7 shows a cutaway view of FIG. 5.

FIG. 7 shows a cutaway of the new trigger primary shoe (24) with no pressure applied to the non-adjustable secondary trigger shoe (30), pivot pin (28), spring (36), and the trigger movement arresting contact surface (32) in contact with the magazine catch bar (16) trigger bow (26) and follow through contact surface (34).

Figure 8:
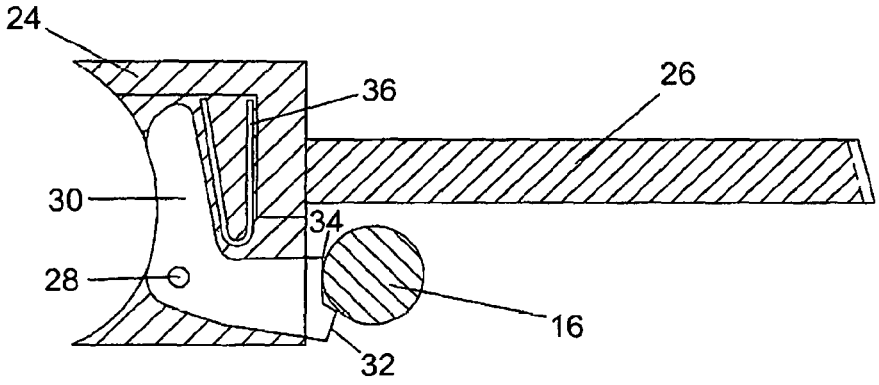
FIG. 8 shows a cutaway view of FIG. 5 with trigger in the fired position and the secondary trigger shoe follow through contact surface in contact with the magazine catch bar.

FIG. 8 shows trigger device in fired position with cutaway of trigger shoe (24) with non-adjustable secondary shoe (30) depressed by finger pressure, and flush with the primary trigger shoe (24), compressed spring (36), trigger pivot pin (28) trigger bow (26) trigger arresting contact surface (32) rotated down, and trigger follow through surface (34) in contact with the magazine catch bar (16).

Figure 9:
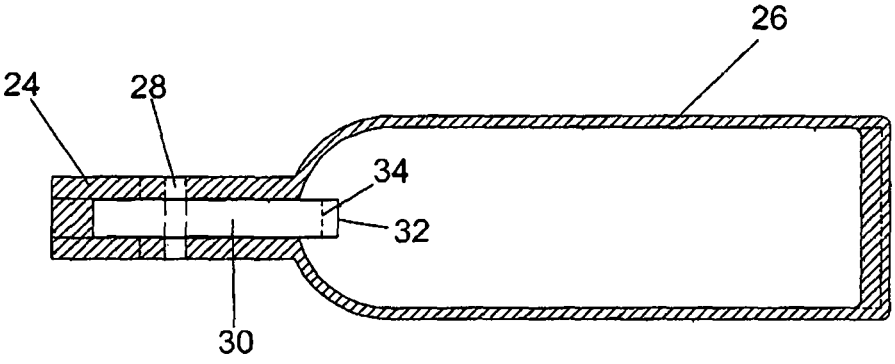
FIG. 9 shows a bottom view of the new trigger assembly of FIG. 5.

FIG. 9 shows bottom view of new trigger assembly, showing primary trigger shoe (24) non-adjustable secondary trigger (30), pivot pin (28), follow through contact surface (34), trigger arresting surface (32) and trigger bow (26).

Figure 10:
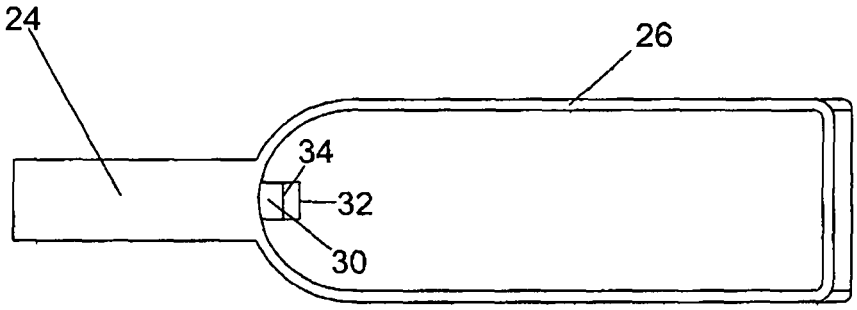
FIG. 10 shows a top view of the new trigger assembly of FIG. 5.

FIG. 10 shows top view of new trigger assembly, showing trigger primary shoe (24), new trigger bow (26), non-adjustable secondary trigger (30), follow through contact surface (34), and trigger arresting contact surface (32).

Figure 11:
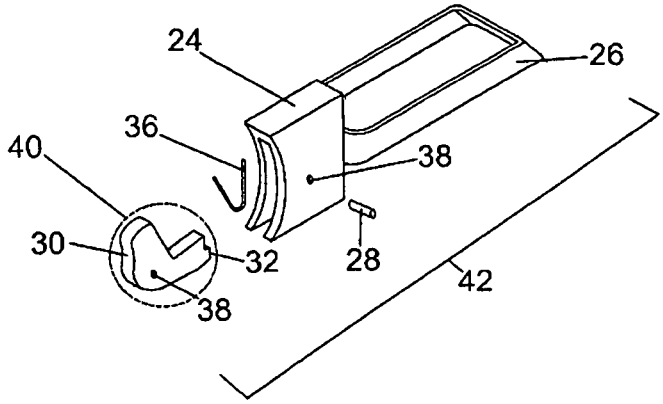
FIG. 11 is an exploded view of the new trigger assembly of FIG. 5.

FIG. 11 shows exploded view of new trigger assembly (42), with non-adjustable secondary trigger shoe (30), primary trigger shoe (24), trigger bow (26) spring (36), through holes (38), trigger pin (28) and enlargement circle of non-adjustable secondary trigger shoe (30).

Figure 12:
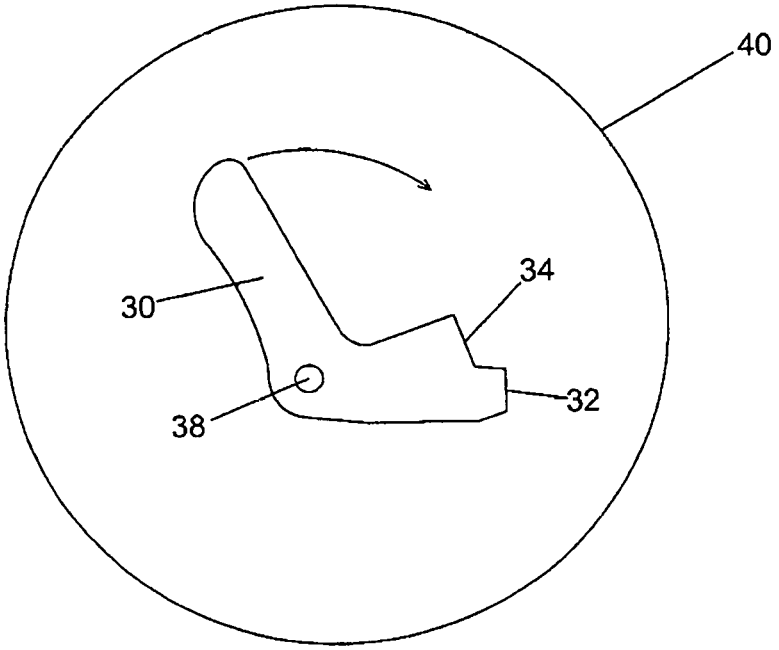
FIG. 12 is an enlarged view of a non-adjustable secondary trigger shoe.

FIG. 12 shows enlargement circle view (40), of non-adjustable secondary trigger shoe (30), with direction of rotation arrow, trigger pivot pin through hole (38), trigger follow through contact surface (34), and the trigger arresting contact surface (32).

Figure 13:
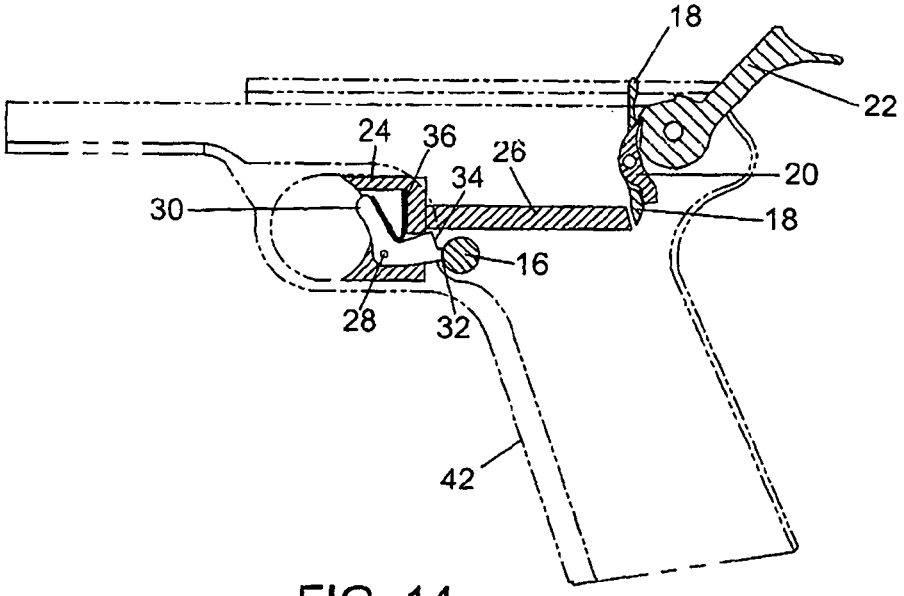
FIG. 13 is the non-adjustable trigger assembly of FIG. 5 in the safe arrested position, within the outline of Colt 1911 frame.

FIG. 13 shows the new non-adjustable trigger assembly in the safe arrested position, within the outline of Colt 1911 frame (42) with primary trigger shoe (24), cut away showing non-adjustable secondary trigger shoe (30) spring (36) pivot pin (28) arresting contact surface (32) against the magazine catch bar (16), follow through contact surface (34), trigger bow (26), and related firing components, sear (20), disconnector (18), and hammer (22).

Figure 14:
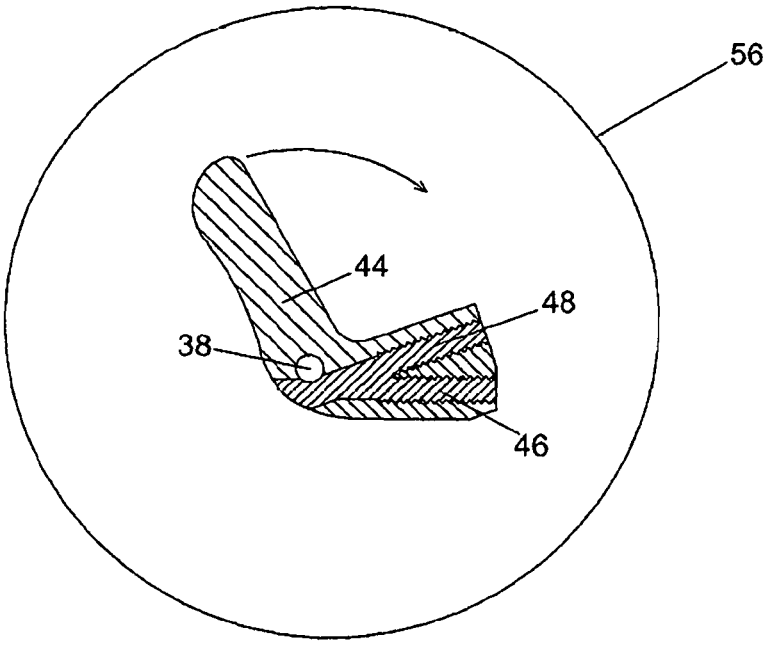
FIG. 14 is an enlarged view of an adjustable secondary trigger shoe.

FIG. 14 shows enlargement circle (56), of an adjustable secondary trigger shoe (44) through hole (38) and threaded passage ways (46) for trigger arresting set screw, threaded passage way (48) for trigger follow through set screw, and direction of rotation arrow.

Figure 15:
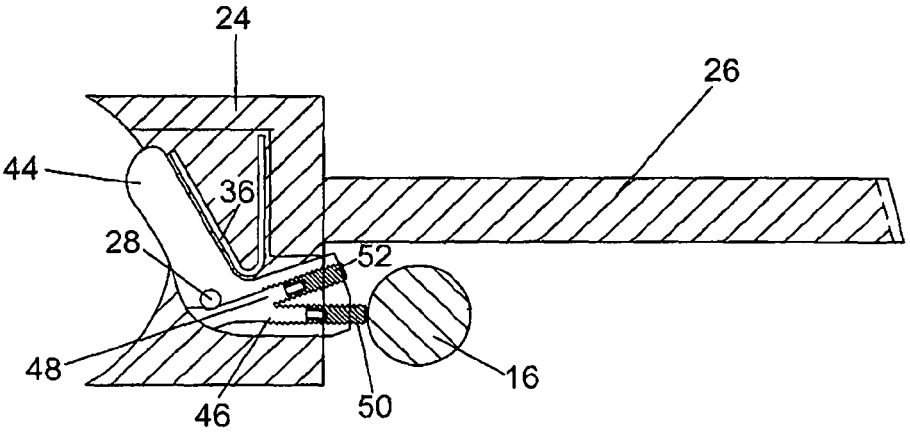
FIG. 15 is a cutaway view of adjustable trigger assembly of FIG. 14 in safe arrested position.

FIG. 15 shows adjustable trigger assembly of this device in safe arrested position, with cutaway of primary trigger show (24), adjustable secondary trigger shoe (44), pivot pin (28), trigger bow (26), spring (36), trigger follow through adjusting set screw (52), trigger arresting set screw (50) in contact with magazine catch bar (16) and trigger threaded passage ways (46) and (48).

Figure 16:
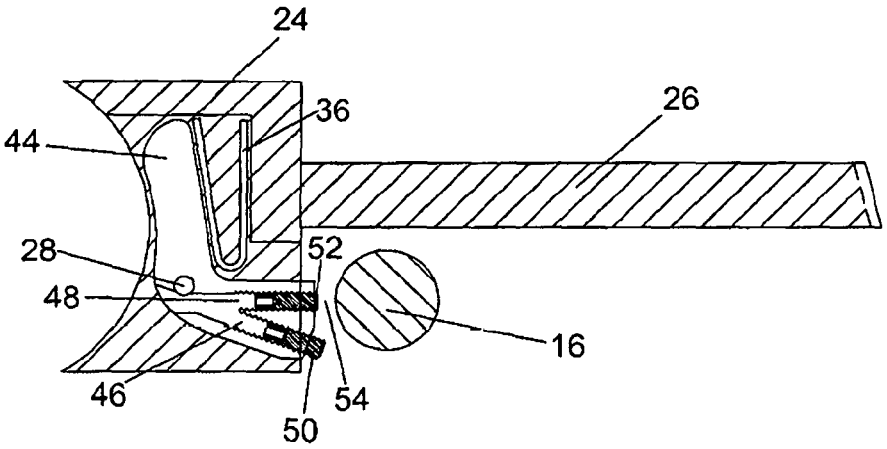
FIG. 16 is a cutaway view of adjustable trigger assembly of FIG. 14 with secondary trigger compressed.

FIG. 16 is the trigger assembly of FIG. 15, shown with adjustable secondary trigger shoe (44), flush with primary trigger shoe (24) due to finger pressure, collapsed spring (36), pivot pin trigger arresting set screw (50), rotated down, with movement gap (54), between (28), follow through set screw (52) and magazine catch bar (16), and threaded passage holes (46) and (48).

Figure 17:
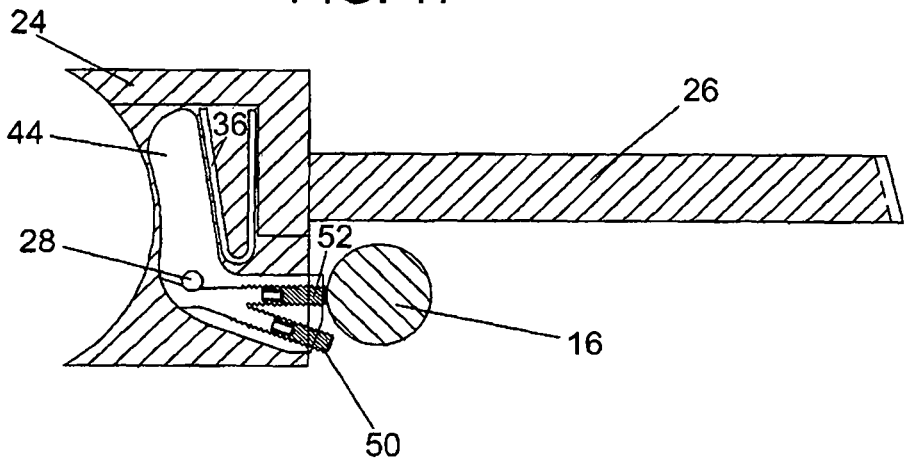
FIG. 17 is a cutaway view of adjustable trigger assembly of FIG. 14 with secondary trigger compressed and with follow through screw in contact with magazine catch bar.

FIG. 17 is the trigger assembly of FIG. 16, shown with the assembly in the fired position, with the trigger follow through set screw (52) in contact with the magazine catch bar (16) stopping reward trigger movement.

Figure 18:
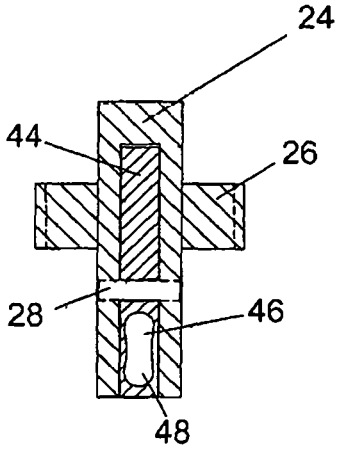
FIG. 18 is a front view of FIG. 17.

FIG. 18 shows a front end view of new adjustable trigger assembly with, primary trigger shoe (24), adjustable secondary trigger shoe (44), pivot pin (28), trigger bow (26), and passageway of set screw holes (46) & (48).

Figure 19:
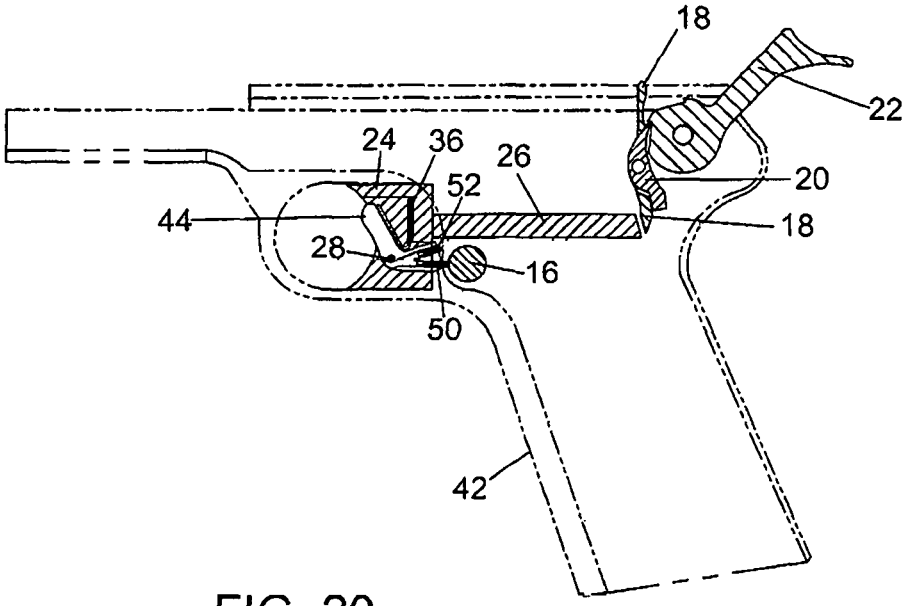
FIG. 19 is a cutaway showing assembly of FIG. 17 within the outline of Colt 1911 frame.

FIG. 19 shows a cutaway of primary trigger shoe (24), adjustable secondary trigger shoe (44), with trigger in safe blocked position from movement with arresting set screw (50), contacting magazine catch bar (16) shown within model 1911 Colt frame outline (42) and related firing components, trigger bow (26) sear (20) disconnector assembly (18) and hammer (22).

Figure 20:
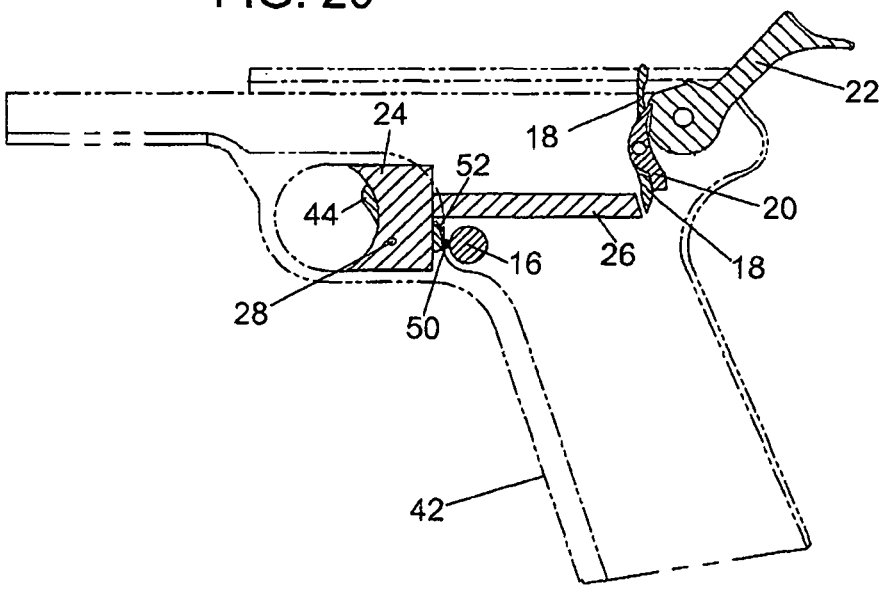
FIG. 20 is a side view of trigger assembly of FIG. 17 and related firing components within the outline of Colt 1911 frame.

FIG. 20 shows the trigger assembly of FIG. 19 without the cut away of the primary trigger shoe (24) showing trigger assembly in the safe or blocked position within the Colt frame outline (42)

The device of this application replaces the original single stage trigger that only functions to fire the Colt model 1911 pistol. The original single stage trigger assembly consists of a trigger shoe (12) and a trigger bow (14) joined together to form a single assembly (10) seen in FIGS. 1, 2, 3, and 4. This new device is a two stage trigger that both blocks trigger movement (stage one) and fires the pistol (stage two). The function of the two stage trigger is accomplished by a rotatable blocking device contacting the magazine catch bar present in the Colt model 1911 pistol and its clones. The secondary trigger shoe is the blocking device, and may be constructed with or without adjustable features. The non-adjustable secondary trigger shoe (30) would be less costly to produce, however many shooters would pay the extra expense to have an adjustable secondary trigger shoe (44). Other than the adjustable trigger shoe with its adjustable set screws, the trigger assembly would be the same as the non-adjustable trigger assembly. A spring loaded secondary trigger shoe number (44) or (30), mounted on a pin which functions as an axle (28), within a primary trigger shoe number (24) is seen in FIGS. 7, and 8. Located on the rearward end of the secondary trigger shoe are the either of two means to stop trigger movement. The non-adjustable stops are trigger arresting contact surface (32) and the follow through arresting contact surface (34). The adjustable secondary trigger shoe would have the trigger arresting set screw (50) and the trigger follow through set screw (52) for arresting trigger movement as seen in FIGS. 7, 8, 15, and 16. At the rearward end of the primary trigger shoe number (24), is a trigger bow number (26) seen in FIG. 5, 7, 8, 9, 10, 11, 13, 15, 16, 17, 19, and FIG. 20, which transfers trigger movement around both sides of the pistols ammunition magazine to the related firing mechanism, consisting of the disconnector assembly (18), sear number (20), and hammer number (22) seen in FIG. 13, 17,19, and FIG. 20.

The workings of the two stage trigger begins with no pressure applied to the trigger assembly, and the trigger blocked from movement by the secondary trigger shoe arresting surface (32) or trigger arresting set screw (50) in contact with the magazine catch bar (16), seen in FIG. 5, 6, 7, 13, 15,19, and FIG. 20). The magazine catch bar is present on all Colt 1911 models and clones and the location of the catch bar is standardized to allow use of a standard magazine. The secondary trigger shoe is held in the forward position by spring pressure pushing between the secondary trigger shoe, number (30) or (44) and the primary trigger shoe (24) seen in FIG. 7,13,15, and FIG. 19. When finger pressure is applied to the protruding front of the secondary trigger shoe (30) or (44), the spring (36) begins to collapse and the shoe begins to rotate on the trigger pin (28) causing the rearward end of the shoe containing the trigger arresting surface (32) or the adjustable set screw (50) to rotate downwards and away from the magazine catch bar (16) producing a gap (54) between the secondary trigger shoe and the magazine catch bar which removes the blocking of the trigger assembly and allows movement. As continued pressure is applied, the secondary trigger shoe continues to rotate down until the trigger follow through contact surface (32) or the follow through set screw (52) is level with the magazine catch bar (16) seen in FIG. 8,16, and FIG. 17. With continued pressure, the secondary trigger shoe becomes flush with the primary trigger shoe seen in FIG. 8, 16, and FIG. 17, and finger pressure now acts upon the primary trigger shoe (24) as seen in FIG. 8. 16, and FIG. 17. As the rearward movement causes the gap (54) seen in FIG. 16, between the secondary trigger shoe and the magazine catch bar to decrease, the trigger assembly bow (26) applies pressure to the related firing mechanism, disconnector (18), sear (20), and hammer (22), causing the pistol to fire the chambered round of ammunition. After the pistol has fired the round, the primary trigger continues to travel rearward until the secondary trigger follow through contact surface (32) or the secondary trigger follow through set screw (52), makes contact with the magazine catch bar (16) seen in FIGS. 8, and 17 stopping further trigger movement and completing the trigger cycle.

I claim:

1. A trigger safety assembly for a single-action, semi-automatic, magazine-fed, recoil-operated pistol having a linearly sliding trigger and a magazine catch bar, the trigger safety assembly comprising:

a primary trigger shoe;

a secondary trigger shoe displaceable relative to said primary trigger shoe, said secondary trigger shoe engaging the magazine catch bar in a safe position blocking movement of said primary trigger shoe and being displaceable into an unblocked position from the magazine catch bar and allowing movement of the primary trigger shoe for firing the pistol;

a pivot pin for pivotably mounting said secondary trigger shoe to said primary trigger shoe;

a spring disposed for providing resistance to pivoting motion of the secondary trigger shoe relative to the primary trigger shoe;

wherein said secondary trigger shoe and said primary trigger shoe are configured to be sequentially contacted by a user's finger to effect firing of the pistol.

2. The trigger safety assembly according to claim 1, wherein said secondary trigger shoe has a trigger arresting contact surface that contacts the magazine catch bar in the safe position and a follow through contact surface radially offset from said trigger arresting contact surface that contacts the magazine catch bar in a fired position.

3. A trigger safety assembly for a single-action, semi-automatic, magazine-fed, recoil-operated pistol having a linearly sliding trigger and a magazine catch bar, the trigger safety assembly comprising: a primary trigger shoe; a secondary trigger shoe displaceable relative to said primary trigger shoe, said secondary trigger shoe engaging the magazine catch bar in a safe position blocking movement of said primary trigger shoe and being displaceable into an unblocked position from the magazine catch bar and allowing movement of the primary trigger shoe for firing the pistol; a pivot pin for pivotably mounting said secondary trigger shoe to said primary trigger shoe; a spring disposed for providing resistance to pivoting motion of the secondary trigger shoe relative to the primary trigger shoe; wherein said secondary trigger shoe has a trigger arresting contact surface that contacts the magazine catch bar in the safe position and a follow through contact surface radially offset from said trigger arresting contact surface that contacts the magazine catch bar in a fired position.

* * * * *